US006841730B2

(12) United States Patent
Medeiros et al.

(10) Patent No.: US 6,841,730 B2
(45) Date of Patent: Jan. 11, 2005

(54) CONSTRUCTIVE ARRANGEMENT FOR THE STARTING SYSTEM OF AN ELECTRIC MOTOR

(75) Inventors: Neto Luiz Magalhaes Medeiros, Joinville-SC (BR); Filho Jose Feuser, Joinville-SC (BR); Julio Cesar Rodrigues, Joinville-SC (BR)

(73) Assignee: Empresa Brasileira de Compressores S.A. -Embraco, Joinville (BR)

( * ) Notice: Subject to any disclaimer, the term of this patent is extended or adjusted under 35 U.S.C. 154(b) by 0 days.

(21) Appl. No.: 10/433,865

(22) PCT Filed: Nov. 30, 2001

(86) PCT No.: PCT/BR01/00143

§ 371 (c)(1),
(2), (4) Date: Nov. 11, 2003

(87) PCT Pub. No.: WO02/47236

PCT Pub. Date: Jun. 13, 2002

(65) Prior Publication Data

US 2004/0066591 A1 Apr. 8, 2004

(30) Foreign Application Priority Data

Dec. 4, 2000 (BR) ..... 0006259
Jun. 28, 2001 (BR) ..... 0103585

(51) Int. Cl.[7] ..... H02G 3/08

(52) U.S. Cl. ..... 174/50; 174/50; 361/23; 248/906

(58) Field of Search ..... 174/50, 58; 248/906; 439/535; 361/22, 23, 24, 27; 318/788, 792

(56) References Cited

U.S. PATENT DOCUMENTS 4,387,412 A 6/1983 Woods et al.
4,422,120 A * 12/1983 Kobayashi et al. ..... 361/24
4,467,385 A 8/1984 Bandoli et al.
4,701,824 A * 10/1987 Beggs et al. ..... 361/24
4,862,306 A * 8/1989 Lisauskas ..... 361/24
5,729,416 A 3/1998 Renkes et al.
6,433,975 B1 * 8/2002 Satoh et al. ..... 361/23

FOREIGN PATENT DOCUMENTS

EP 0 793 068 A1 9/1997

* cited by examiner

*Primary Examiner*—Dhiru R. Patel
(74) *Attorney, Agent, or Firm*—Darby & Darby

(57) ABSTRACT

A constructive arrangement for the starting system of an electric motor, comprising a basic body (10), to which are mounted a cover (20), a starting device (30) and a motor protector (40, 40'), said basic body (10) being provided, on an external face (11), with a projecting rod (12) for affixing the capacitor, a pair of first openings (13) for the fitting of respective terminals of a capacitor (2), to be coupled to the projecting rod (12); a first energizing opening (15) for electric connection to the starting device (30); and a second energizing opening (16), for electric connection to the protector motor (40), said basic body (10) defining a first housing (17) for receiving the starting device (30) and being closed by the cover (20) opposite to the projecting rod (12) and provided with two receiving openings (21) for receiving two pins for electric connection to the motor, the motor protector (40, 40') being provided with a female connector (41) for introduction of a third pin for electric connection of the motor, and which is mounted inside a second housing (17), the motor protector (40, 40') being electrically associated with a contact pin (42, 42') aligned with the second energizing opening (16).

31 Claims, 7 Drawing Sheets

FIG.1
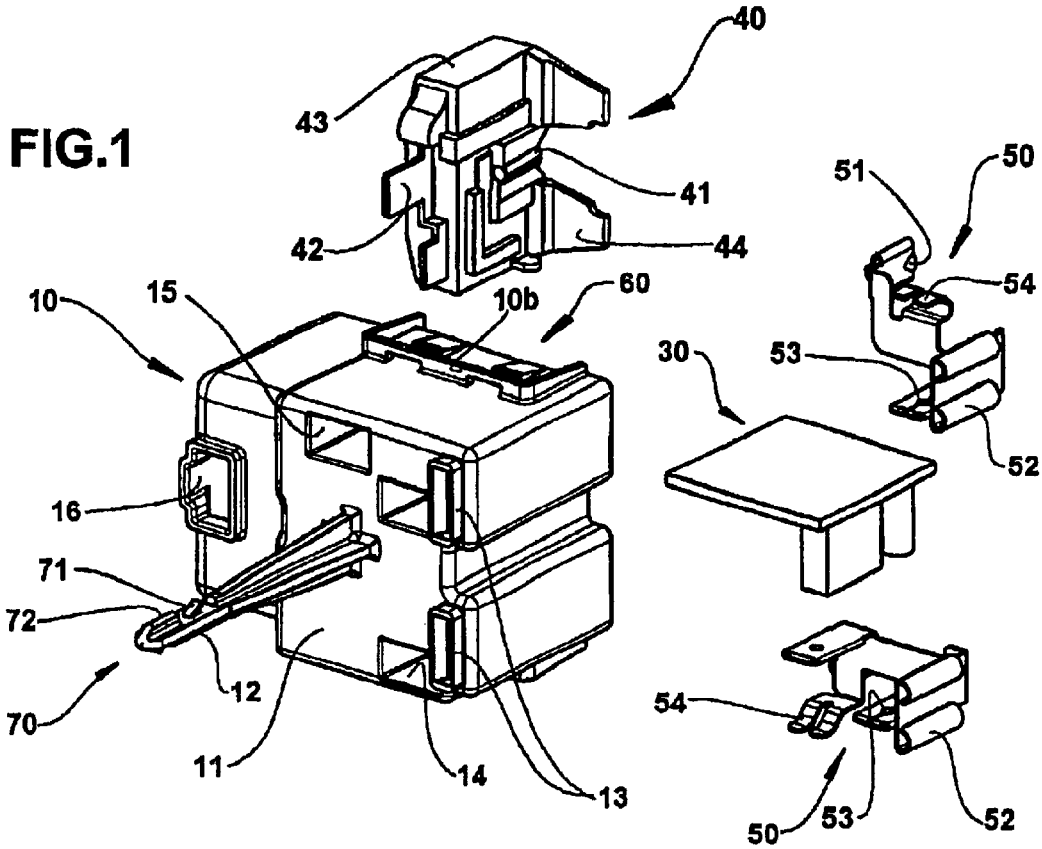
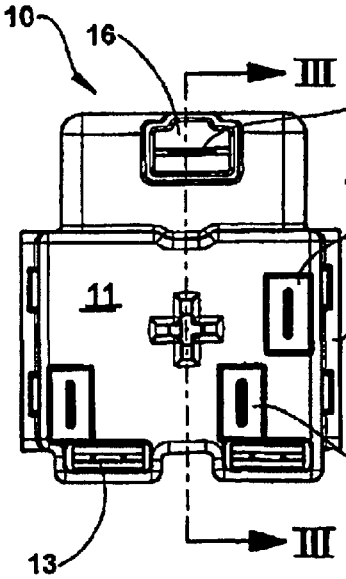
FIG.2
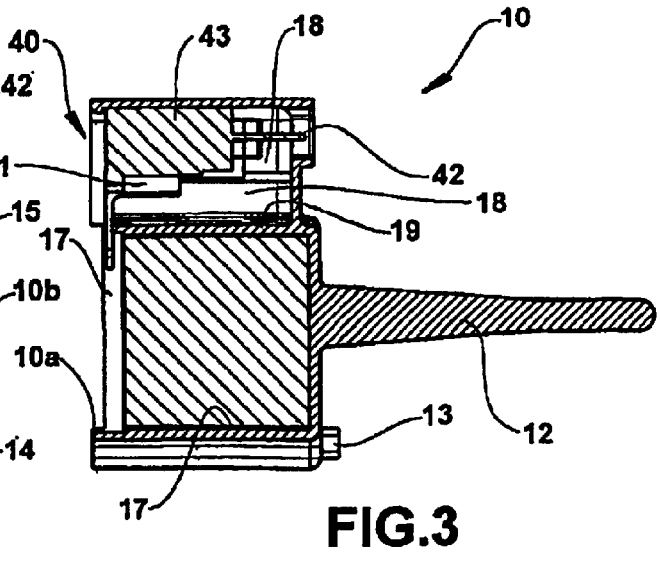
FIG.3

CONSTRUCTIVE ARRANGEMENT FOR THE STARTING SYSTEM OF AN ELECTRIC MOTOR

CROSS REFERENCE TO PRIOR APPLICATIONS

This is a U.S. national phase application under 35 U.S.C. §371 of International Patent Application No. PCT/BR01/00143 filed Nov. 30, 2001, and claims the benefit of Brazilian Application Nos. PI 0006259-6, filed Dec. 4, 2000 and PI 0103585-1, filed Jun. 28, 2001. The International Application was published in English on Jun. 13, 2002 as International Publication No. WO 02/47236 A2 under PCT Article 21(2).

FIELD OF THE INVENTION

The present invention refers to a constructive arrangement for the starting system of the type used in electric motors, particularly in single-phase induction motors used in refrigerating hermetic compressors.

BACKGROUND OF THE INVENTION

Single-phase induction motors are widely used, due to their simplicity, strength and high performance. They are generally found in household appliances, such as refrigerators, freezers, air conditioners, hermetic compressors, washing machines, pumps, fans, as well as in some industrial applications.

The known induction motors are usually provided with a cage type rotor and a coiled stator, having two windings, one for the running coil and the other for the starting coil. During the normal operation of the compressor, the running coil is supplied by an alternate voltage and the starting coil is temporarily supplied at the beginning of the starting operation, creating a turning magnetic field in the air gap of the stator, a necessary condition to accelerate the rotor and promote motor starting.

This turning magnetic field may be obtained by supplying the starting coil with a current that is time-displaced in relation to the current flowing in the main coil, preferably at an angle close to 90 degrees. This time-displacement between the current flowing in both coils is achieved by constructive characteristics of the coils, or by installing an external impedance in series with one of the coils, but generally in series with the starting coil. The value of this current flowing in the starting coil during the starting process of the motor is generally high, being necessary to use a type of switch for interrupting this current after the time required for promoting the acceleration of the motor has elapsed.

In motors in which a very high efficiency is required, this starting coil is not completely disconnected after the starting period has elapsed, and a capacitor, namely a running capacitor, is maintained connected in series with said starting coil, providing enough current to increase the maximum torque and efficiency of the motor.

For motors with this configuration using a permanent impedance in series with the starting coil during the normal operation of the motor, some starting devices of the PTC or electronic types are known, as described in U.S. Pat. No. 5,051,681.

Other constitutive component of the known starting and protection modules for the electric motors is the thermal protector, which has the function to protect the electric motor in short circuit or overload conditions. This component may be mounted directly to an energizing pin of the compressor or lodged next to it, and connected to said compressor by electric conductors, or also installed in the interior of the compressor, in contact, for example, with the windings of the electric motor.

In some known constructions for a starting system, the latter comprises a module, which lodges therewithin a starting device and a motor protector, and externally carries at least one capacitor, the running capacitor, which is affixed to this module through a capacitor support (U.S. Pat. No. 5,170,307), or directly to said module (U.S. Pat. No. 5,729,416).

In other known constructions, the starting system either dispenses the use of capacitors, or allows the running capacitor (and also the starting capacitor, if provided) to be operatively coupled to the module of said starting system by adequate connecting cables (WO98/21735).

In the constructions in which the running capacitor is affixed to the module of the starting system, directly thereto or through the support, there is provided a fixed or removable rod, having a pin at its free end to receive an engaging portion of the running capacitor. In the solution of U.S. Pat. No. 5,729,416, the end of the fixation rod of the running capacitor is provided with lateral grooves, so as to immobilize the capacitor attached to the module of the starting system. Nevertheless, these grooves do not prevent the involuntary displacement of the running capacitor from its engaging position in relation to the module, since said grooves do not provide axial retention thereto.

Although the known module solutions of starting systems represent a simplification in the assembly of the starting and the protecting elements of the electric motor of compressors, such known systems present the disadvantage of not being sufficiently versatile to allow their adaptation to different configurations and applications for the starting system of an electric motor, requiring, for each variety, a starting system with proper specifications. In the solution proposed in U.S. Pat. No. 5,729,416, the constructive arrangement comprises a shell, which is formed by a basic body lodging a starting device and a thermal protector, which is completely and definitively closed during manufacture, requiring a specific construction as a function of the application to be given to the starting system. Thus, after leaving the assembly lines, the constructive arrangement object of U.S. Pat. No. 5,729,416 does not allow the rearrangement of the components, since the shell is entirely closed, enclosing therewithin the starting device and the thermal protector used in the manufacture. This constructive characteristic forces the customer of the electric motor to store different types of modules directed to different applications. If, for example, a problem occurs in the thermal protector, the whole module must be replaced, spoiling the starting device. The same is true if the defect occurs in the starting device. Furthermore, since the cover is designed to close the whole basic body of the shell, it is not possible to replace any of the components defined by the starting device and the thermal protector.

Another characteristic of the known constructive arrangements is that, in case an insulating protection is required to prevent the user from accessing the supply terminals of the module, the shell is constructed with a specific design, in order to incorporate a double tubular extension, involving the openings for the supply terminals. For this purpose, it is necessary to duplicate the number of tools for manufacturing the different types of shells, increasing costs and reducing the productivity during manufacture, besides increasing the number of stored items.

OBJECTS OF THE INVENTION

Thus, it is an object of the present invention to provide a constructive arrangement for the starting system of an electric motor, with a strong and simple construction, of easy assembly and sufficiently versatile to allow modifications in the arrangement of the components, after manufacturing the module that defines the starting system, as well as in the electric insulating protecting means of the supply terminals, without causing loss of components, or using different shell designs.

A further object of the present invention is to provide a constructive arrangement for the starting system of an electric motor, such as mentioned above, which, in case a capacitor is mounted directly affixed to the module of said starting system, it avoids the connection of other capacitor of the same type to said module, avoiding as well the access to the energized and unused terminals of these modules.

SUMMARY OF THE INVENTION

The constructive arrangement for the starting system of an electric motor of the present invention is of the type comprising a basic body, to which are mounted a cover, a starting device and a motor protector. The basic body comprises on an external face: a projecting rod for affixing a capacitor; a pair of first openings for the fitting of respective terminals of a capacitor to be coupled to the projecting rod, said pair of first openings being arranged in alignment with a pair of first electric connectors provided inside the basic body; a first energizing opening, for electric connection to the starting device; and a second energizing opening, for electric connection to the motor protector. The basic body defines a first housing to receive the starting device and which is closed by the cover opposite to the projecting rod and provided with two receiving openings, which are aligned with a pair of female connectors lodged inside the basic body for receiving two pins for electric connection to the motor. The motor protector is provided with a female connector for the introduction of a third pin for electric connection of the motor, and which is mounted inside a second housing laterally affixed to the first housing, the motor protector being provided with a contact pin aligned with the second energizing opening.

In the construction proposed by the invention, the cover is provided only on the first housing, allowing the thermal protector, which is provided on the second housing, to be accessed even after manufacture of the module. Thus, the proposed arrangement allows using only one starting module, which may receive a thermal protector adequate to the specific application to be given to the starting system. The adaptation of the thermal protector may be made during manufacture, in the production lines of the appliances that use said starting systems, or also during maintenance services of appliances, such as the hermetic compressors, at the sites of the final users.

Another aspect to be considered is the reutilization of each one of the two components, depending on which has presented the defect.

Another advantageous characteristics of the arrangement proposed herein will become clear with the description of the invention hereinafter.

BRIEF DESCRIPTION OF THE DRAWINGS

The invention will be described below, with reference to the attached drawings, in which:

FIG. 1 is an exploded perspective view of a first construction for the starting system of an electric motor of the present invention, without the capacitor being coupled to the basic body of said starting system;

FIG. 2 is a top view of the module illustrated in FIG. 1;

FIG. 3 is a longitudinal sectional view of the basic body of the starting system of the present invention, taken according to line III—III of FIG. 2;

DESCRIPTION OF THE ILLUSTRATED EMBODIMENTS

Figure 4:
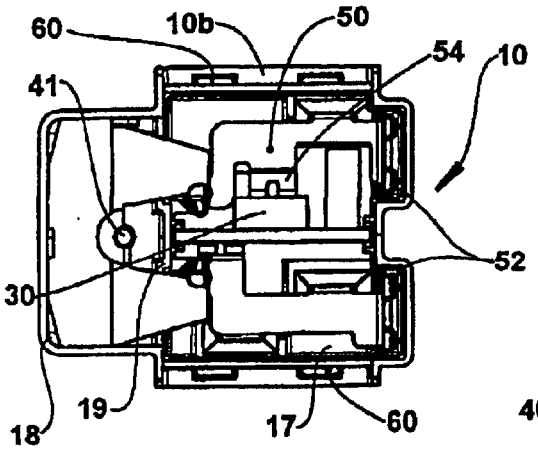
FIG. 4 is a bottom view of the basic body of the starting system illustrated in FIG. 1, with the motor protector, the starting device and the contact terminals thereof being mounted to said basic body.
Figure 5:
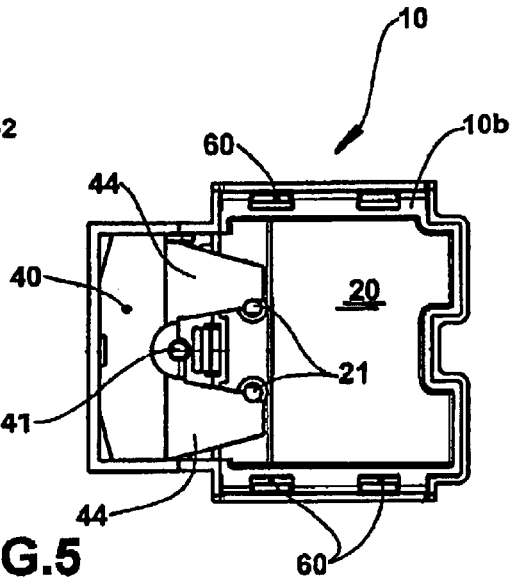
FIG. 5 is a bottom view of the basic body illustrated in FIG. 4, with the first housing being closed by a cover.

The present invention describes a constructive arrangement for the starting system of an electric motor, for example of the single-phase induction type used in a hermetic compressor for refrigeration systems.

The constructive arrangement for the starting system of the present invention comprises: a basic body 10 made of an electrically insulating material, to which is mounted a cover 20; a starting device 30; and a motor protector 40 provided with a female connector 41.

According to the constructions illustrated in FIGS. 1–13, the basic body 10 presents, incorporated to an external face 11, a projecting rod 12 for affixing a capacitor, and a pair of first openings 13 and a pair of second openings 14, for fitting terminals of a capacitor 2, for example a running capacitor, said first openings 13 being dimensioned to fit the terminals of a capacitor 2 mounted to the projecting rod 12, and the second openings 14 being dimensioned to receive terminals of connecting cables (not illustrated), for connection to a capacitor 2, which is mounted to the electric motor distant from the basic body 10 of the starting system of the present invention, said pairs of first and second openings 13, 14 being positioned close to each other, so that the connection through the pair of first openings 13 prevents the connection of any other capacitor 2 through the pair of second openings 14, as well as the access to the pair of openings, which are energized, but not being used for connecting the capacitor 2.

According to said constructions, the second openings 14 are covered by the capacitor 2, when the latter is directly mounted to the basic body 10, by coupling it to the projecting rod 12, which coupling may be achieved, for instance, by interference of the capacitor 2 in relation to the projecting rod 12.

The basic body 10 further presents a first energizing opening 15, for electrical connection to the starting device, and to which is aligned an electric connection resilient means, provided within the basic body 10, and a second energizing opening 16, for electric connection to the motor protector 40, the first energizing connection 15 being laterally defined in relation to the first and the second openings 13, 14, and the second energizing opening 16 being defined opposite to the first openings 13, in order to receive a contact pin 42 of the motor protector 40, in the constructions in which said motor protector 40 is mounted to the basic body 10, as illustrated in FIGS. 1–7, and 11.

The starting system of the present invention includes a first housing 17 for receiving the starting device, and a second housing 18, which is shaped according to the type of motor protector 40 to be used, as illustrated in the illustrated figures, said first housing 17 being defined inside the basic body 10 and closed by a cover 20, the second energizing opening 16 being defined in the second housing 18 to which is aligned the contact pin 42 of the motor protector 40. According to a constructive form of the present invention, the second housing 18 is defined in the interior of the basic body 10, and spaced from the first housing 17 by at least one wall 19, substantially orthogonal to the plane of the cover 20. In a first construction, illustrated in FIGS. 1–5, the basic body 10 defines, in a single piece, the first housing 17 and the second housing 18 with only one common wall 19 therebetween.

For the starting device construction illustrated in FIGS. 1–7, the cover 20 is placed on the basic body 10, closing the first housing 17 prior to the placement of the motor protector 40 in the second housing 18 of the basic body 10. In these constructions, the motor protector 40 has a body portion 43, which is positioned inside the second housing 18, and a pair of base projections 44, which are orthogonal to said body portion 43 and which, during the mounting of the motor protector 40 to the basic body 10, are seated against an external face of said cover 20, in an adjacent portion of the cover 20 closing the first housing 17.

Figure 8:
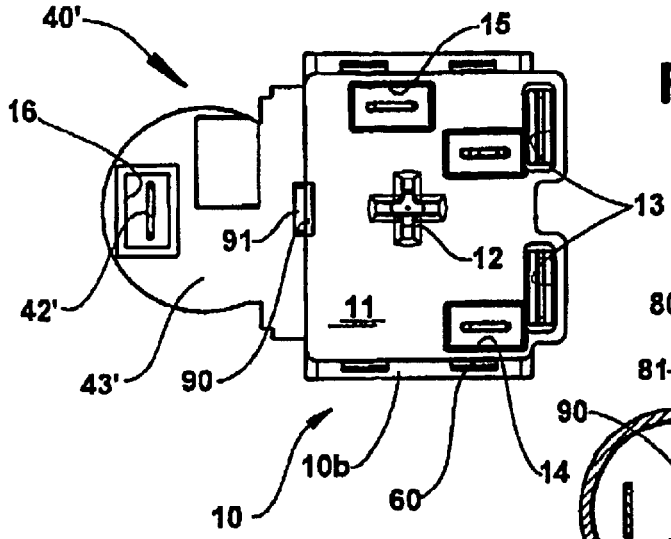
FIG. 8 is a top view of a third construction for the basic body of the starting system of the present invention.
Figure 9:
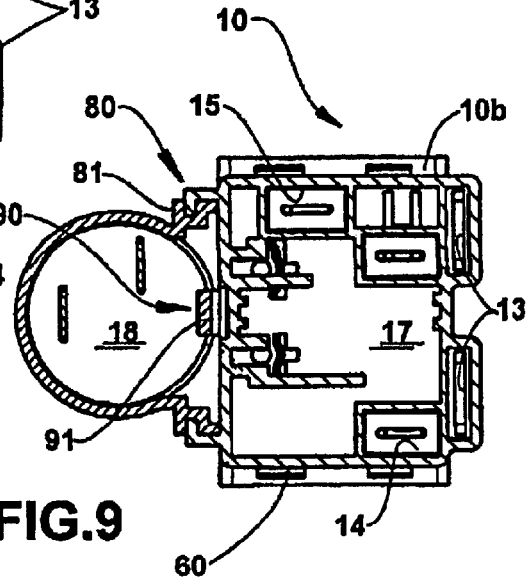
FIG. 9 is a cross sectional view of the basic body illustrated in FIG. 8.

For the starting device construction illustrated in FIGS. 8 and 9, the second housing 18 receives a motor protector 40', presenting a body portion 43' in a cylindrical form, having a contact pin 42'.

As further illustrated in FIGS. 1–7, inside the first housing 17 of the basic body 10, there are also provided a pair of electric contact terminals 50 of the starting device 30, each defining a female connector 51 for receiving a respective contact pin (not illustrated) of the terminal of the electric motor of the compressor, each of said female connectors 51 being arranged in alignment with a respective receiving opening 21 defined in the cover 20.

The electric contact terminals 50 further define a pair of first electric connectors 52, each first electric connector 52 being aligned with one of the first openings 13. Said electric contact terminals 50 further present a pair of second electric contacts 53, each being aligned with a respective second opening 14.

In an illustrated constructive option, the starting device 30 is in the form of an electronic plate, which is mounted inside the first housing 17 of the basic body 10 by pressing the electric connection resilient means 54. Each electric contact terminal 50 has one electric connection resilient means 54, which positions the starting device 30 inside said first housing 17, and makes the electric contact to said starting device 30, one of said electric contact terminals 50 having the respective second electric contact 53 aligned with the first energizing opening 15 of the basic body 10.

The basic body 10 further includes, adjacent to a seating edge 10*a* of the cover 20, and at least on each lateral wall, a respective lateral flange 10*b* provided with cover retaining means 60, for example, in the form of teeth, which fit into fixation means 23, for example in the form of windows defined in the cover 20.

In the illustrated constructions, the basic body 10 defines therewithin, aligned with each first opening 13, a housing for a respective first electric connector 52 of an electric contact terminal 50.

The cover 20 in the illustrated construction has at least two peripheral walls 25, which project from a closing face 26 of the cover 20, and on which are provided the fixation means 23.

According to the present invention, the projecting rod 12 for affixing the capacitor is provided with axial retaining means 70, which actuate to retain a capacitor 2 mounted to the basic body 10, in its position electrically coupled to the first openings 13 of the latter. In the illustrated constructions, the axial retaining means 70 include at least one fixation tooth defined at least in part of the peripheral contour of the projecting rod 12.

In a constructive option of the present invention, the axial retaining means 70 of the projecting rod 12 define at least one first retaining tooth 71, and a second retaining tooth 72, as described hereinafter and illustrated in FIG. 1.

Figure 12:
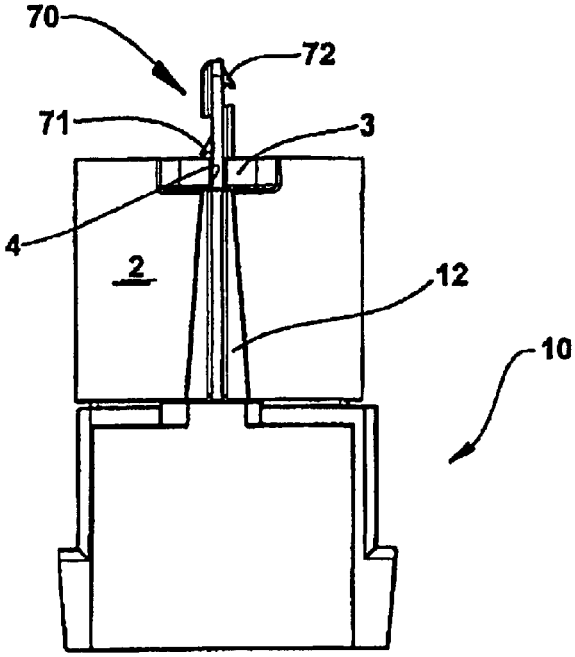
FIG. 12 is a front view of the module of FIG. 10, carrying a capacitor construction.
Figure 13:
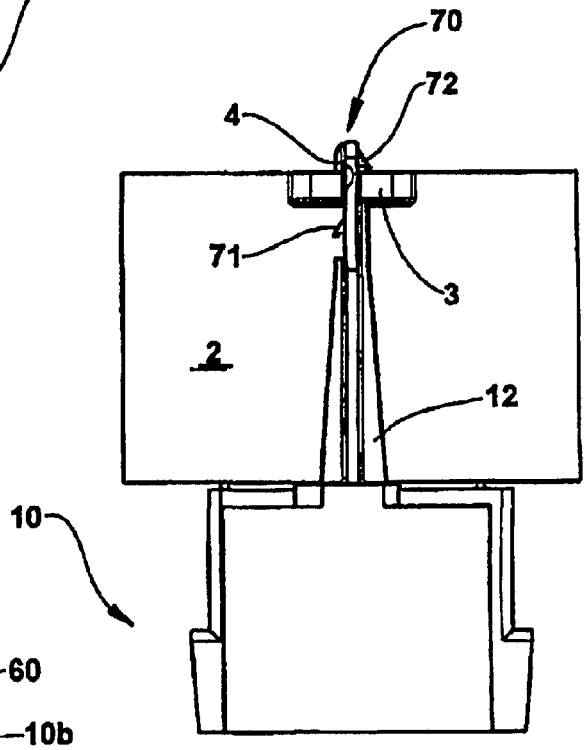
FIG. 13 is a front view of the module of FIG. 12, carrying another capacitor construction.
Figure 11:
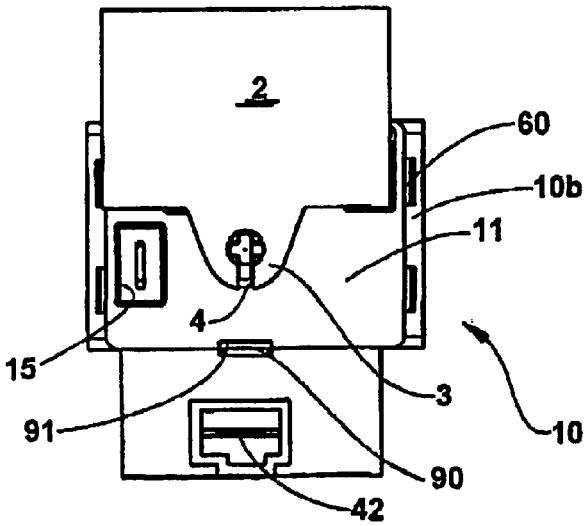
FIG. 11 is a top view of the module in FIG. 1, with a capacitor being mounted thereto.
Figure 14:
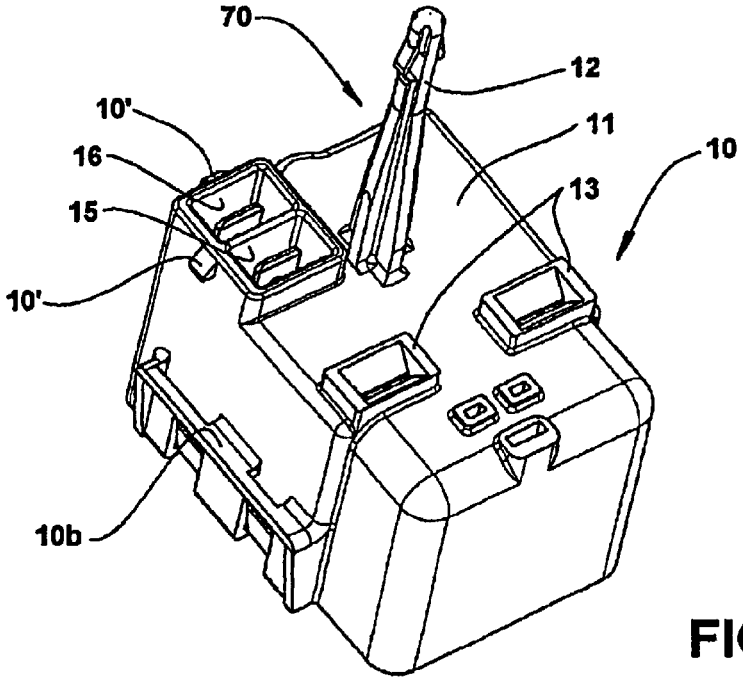
FIG. 14 is a front perspective view of a fifth construction for the present starting system, without the capacitor.
Figure 15:
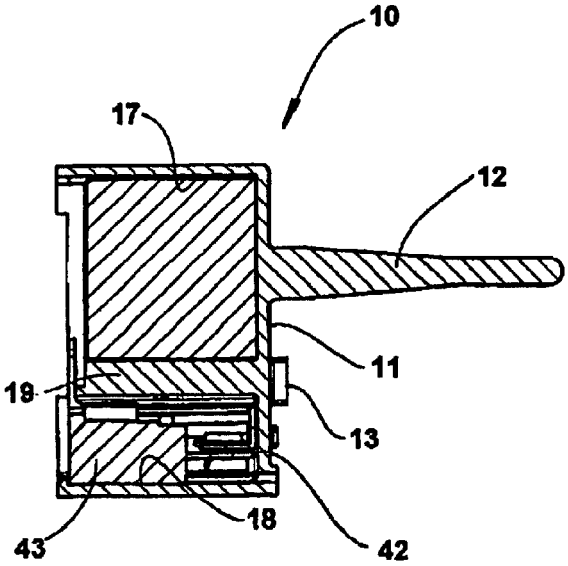
FIG. 15 is a sectional view of the basic body illustrated in FIG. 14.
Figure 16:
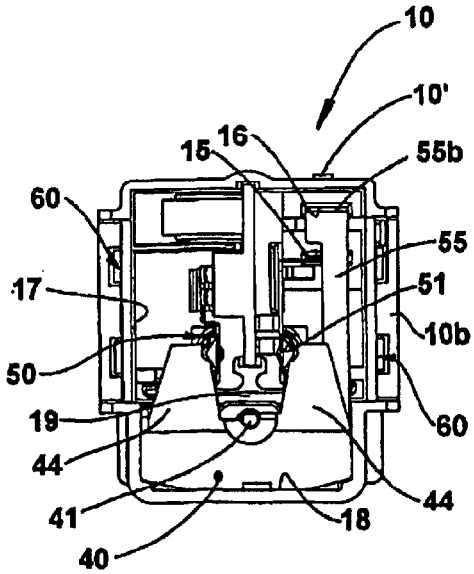
FIG. 16 is a bottom view of the basic body illustrated in FIG. 14 and lodging a motor protector, a starting device and its contact terminals.
Figure 17:
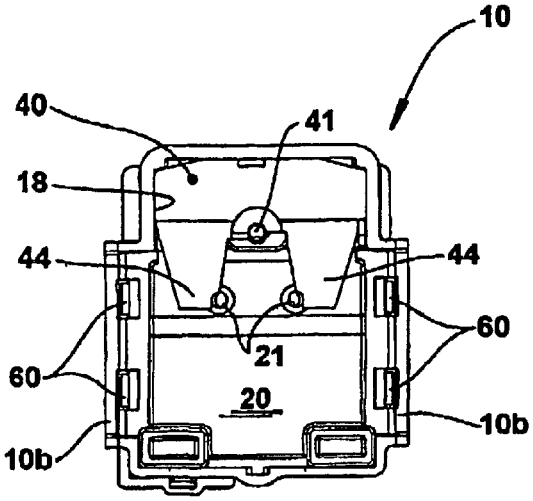
FIG. 17 is a bottom view of the basic body illustrated in FIG. 16, with the first housing closed by a cover.
Figure 18:
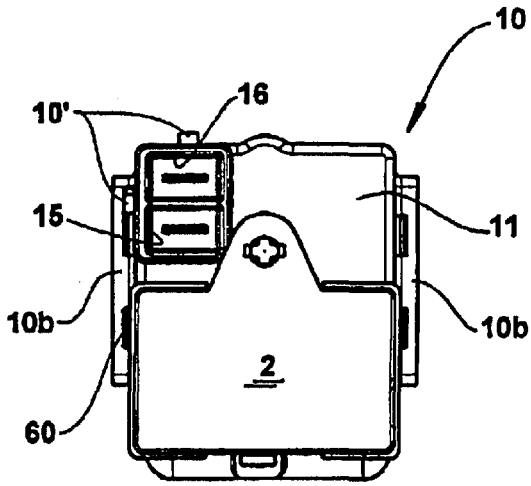
FIG. 18 is a top view of the module of FIG. 14 carrying a capacitor.

According to the illustrations of FIGS. 11–13, on the external face 11 of the basic body 10 is placed a capacitor 2, in the condition directly mounted to the present module, said capacitor 2 presenting an end projection 3 provided with a slot 4, for fitting and retaining the capacitor 2 to the projecting rod 12.

In a constructive option, the fixation of the capacitor 2 to the projecting rod 12 is obtained by interference between said parts, during the fitting of the slot 4 of said capacitor 2 to said projecting rod 12.

In the construction illustrated in FIG. 12, the capacitor 2 is affixed around the projecting rod 12, such that its end projection is inferiorly positioned to at least one first retaining tooth 71 of said projecting rod 12, which tooth is defined in order to assure the retention of a determined type of capacitor 2 to the basic body 10 of the module 1 being described. For capacitors of larger dimension, the projecting rod 12 presents, as illustrated in FIG. 13, at least one second retaining tooth 72, which is vertically positioned above the first retaining tooth 71.

In the embodiment illustrated in FIGS. 11–13, the lower face of the end projection 3 of the capacitor is seated on a wall portion of the projecting rod 12, which, in this embodiment, defines the seating stop for said end projection 3 of the capacitor 2.

In the illustrated constructions, the projecting rod 12 presents, up to the seating region of the end projection, inferiorly to the first retaining tooth 71, two projecting lateral walls, orthogonal to each other, said walls defining a tapering to the projecting rod 12, up to the seating region mentioned above, where a first of said walls is interrupted in order to define the first retaining tooth 71, provided on said first wall, which is one of the walls of the projecting rod 12 parallel to an adjacent lateral wall of the capacitor 2 mounted to the basic body 10. A second wall, opposite to the first wall, defines a second retaining tooth 72, for the end portion 3 of a capacitor 2 with a larger dimension (FIG. 13), said second wall being partially interrupted to define said second retaining tooth 72. The two other orthogonal walls of the projecting rod 12 may be for example, continuous, up to the free end of said projecting rod 12.

According to other way of carrying out the present invention, as illustrated in FIGS. 6–9, the basic body 10 of the present starting system has the first housing engageable to the second housing 18, said engagement being obtained by engaging means 80, which are provided in one of the parts defined by the first housing 17 and the second housing 18, and which are engageable to engagement receiving means 81 provided in the other of said parts.

In this construction, each of said parts defined by the first housing 17 and the second housing 18 includes a locking means 90, which is selectively releasable from and engageable to a locking means 90 provided in the other of said parts, in order to prevent involuntary uncoupling of said parts.

Figure 7:
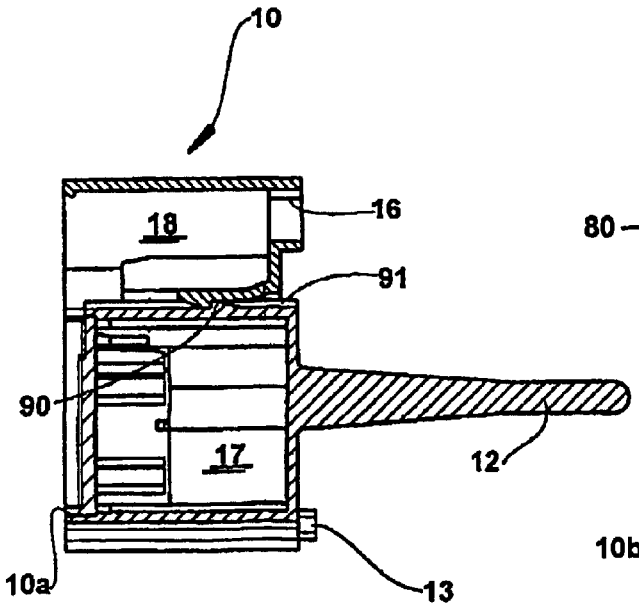
FIG. 7 is a longitudinal sectional view of the basic body of the starting system of the present invention, taken according to line VII—VII of FIG. 6.
Figure 6:
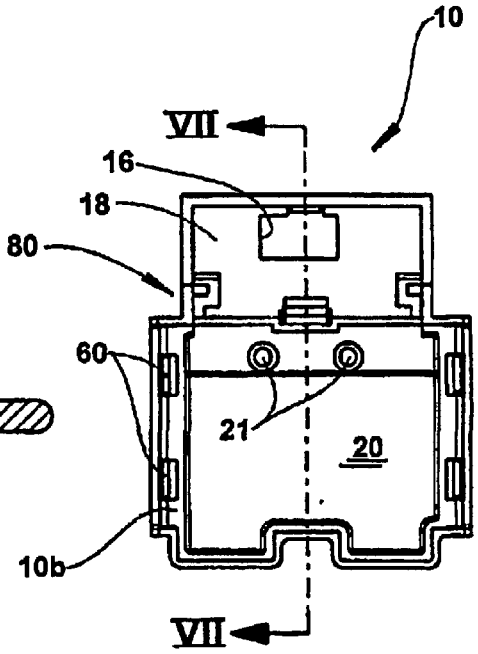
FIG. 6 is a bottom view of a second construction for the basic body of the starting system of the present invention.

According to the illustration of FIG. 7, the locking means 90 are in the form of teeth, each tooth being defined in a guide 91 provided in the respective part of either the first or the second housings 17, 18, in a recessed portion of a lateral wall of said part, said teeth being resiliently deformed during the engagement between the parts of the first and second housings 17, 18, until a mutual seating between the confronting faces of said teeth has been obtained.

In a constructive form illustrated in FIGS. 6–9, the engaging means 80 are mutually and slidingly cooperating guides, at least part of said guides defining a dovetail fitting.

Figure 10:
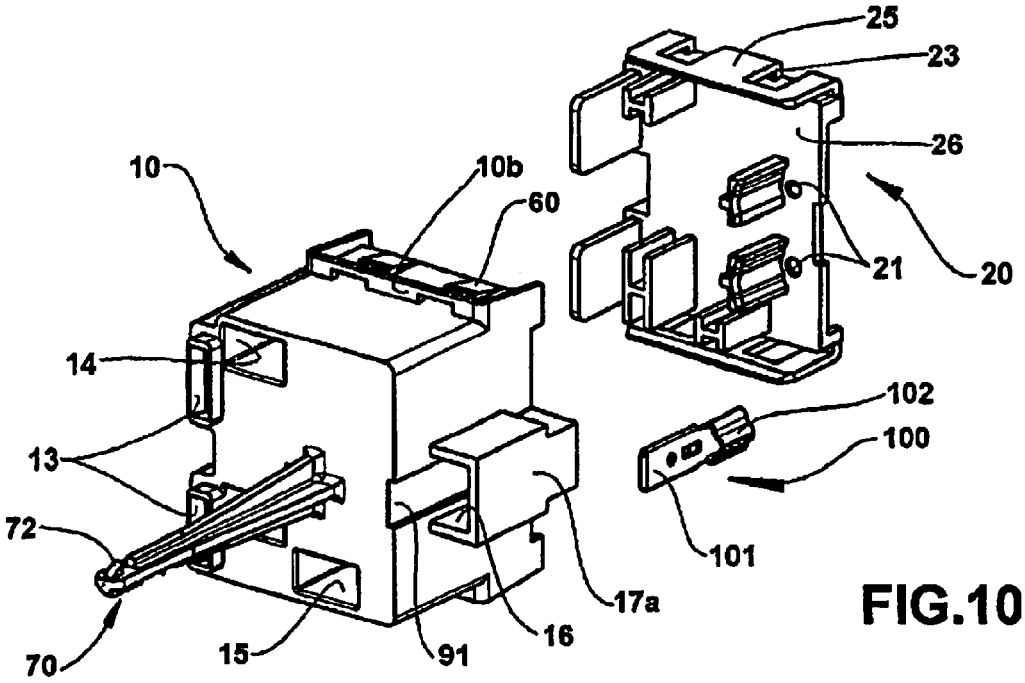
FIG. 10 is an exploded perspective view of a fourth construction for the basic body of the starting system of the present invention.

In another constructive form of the present invention, as illustrated in FIG. 10, the first housing 17 is provided with an energizing terminal housing 17*a* defining the second energizing opening 16, inside which is lodged an energizing terminal 100, having a contact end 101 and defining a female connector 102 in the opposite end thereof, said energizing terminal 100 being electrically and operatively engaged to a motor protector, not illustrated, mounted distant from the basic body 10, for example, inside the compressor.

Although not illustrated, this configuration may still present guides for fitting a motor protector 40, in order to receive the latter in the basic body 10.

FIGS. 14–18 illustrate another possible construction for the present starting system, said construction being described below, with the same reference numbers used for the same parts already described in relation to the illustrated constructions in FIGS. 1–13.

In this construction, the basic body 10 presents a construction similar to those already described, except for the fact that the first and the second energizing openings 15, 16 are provided side by side, close to one of the lateral edges of the external face 11 of the basic body 10 into which is incorporated the projecting rod 12, said first and second energizing openings 15, 16 being opened to the inside of the first housing 17.

The basic body 10 further presents, on said external face 11, only a pair of first openings 13, for fitting the terminals of the capacitor 2 to be mounted to the projecting rod 12, as previously already described.

In this embodiment, the pair of first openings 13 is preferably positioned so as to open to the inside of the first housing 17, at its end region adjacent to the common wall 19 with the second housing 18 and opposite to the location of the energizing openings 15, 16, in relation to the projecting rod 12. It should be understood that the basic body 10 and the cover 20 are constructed according to the other characteristics described hereinbefore, whose definition has not been altered, except for the limitation of the capacitor being connected to only one pair of first openings 13, and for the provision of the first and the second energizing opening 15 and 16 being provided side by side in the region corresponding to the first housing 17.

Also in the construction of FIGS. 14–18, inside the first housing 17 of the basic body 10, there are also provided two electric contact terminals 50 of the starting device 30, each defining one female connector 51, for receiving a respective terminal contact pin of the electric motor, each of said female connectors 51 being in alignment with a respective receiving opening 21 defined in the cover 20.

The electric contact terminals 50 also define a pair of first electric connectors 52, each of which being aligned with a respective first opening 13, as well as electric connection resilient means 54 positioning the starting device 30 inside the first housing 17 and making the electric contact with the starting device 30, one of said electric contact terminals 50, which has the respective second electric contact 53, being aligned with the first energizing opening 15 of the basic body 10, in order to be energized by said first energizing opening 15.

In the construction illustrated in FIGS. 14–18, the first housing 17 carries, internally, a third contact terminal 55, presenting a first connecting portion 55*a*, to be electrically coupled to the contact pin 42, which energizes the thermal protector 40, and a second connecting portion 55*b*, which is operatively associated with a second energizing opening 16 of the basic body 10.

Figure 19:
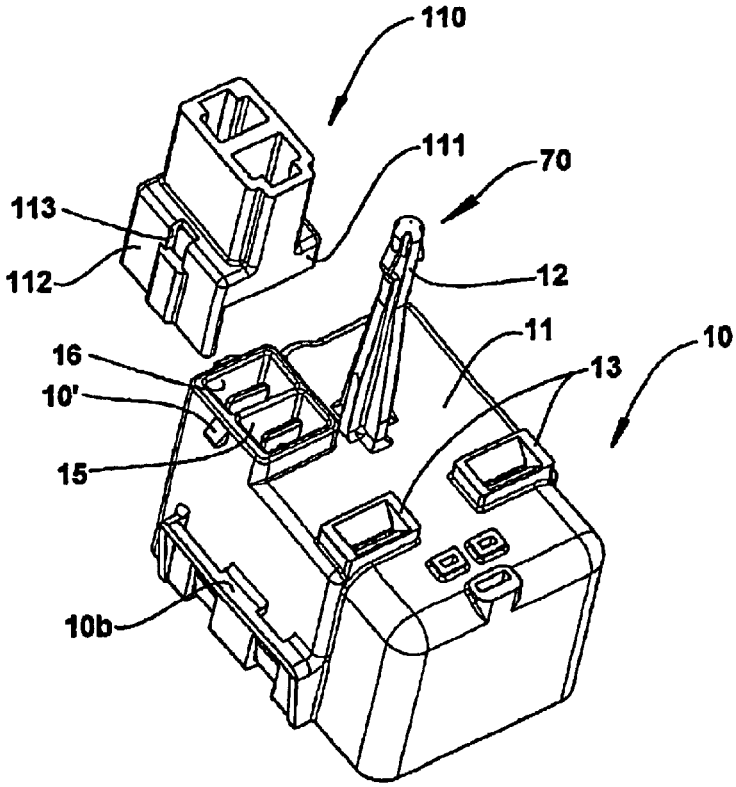
FIG. 19 is a similar view to that of FIG. 1, but illustrating, in an exploded way, a double tubular extension to be engaged to the tubular body, on the energizing openings.
Figure 20:
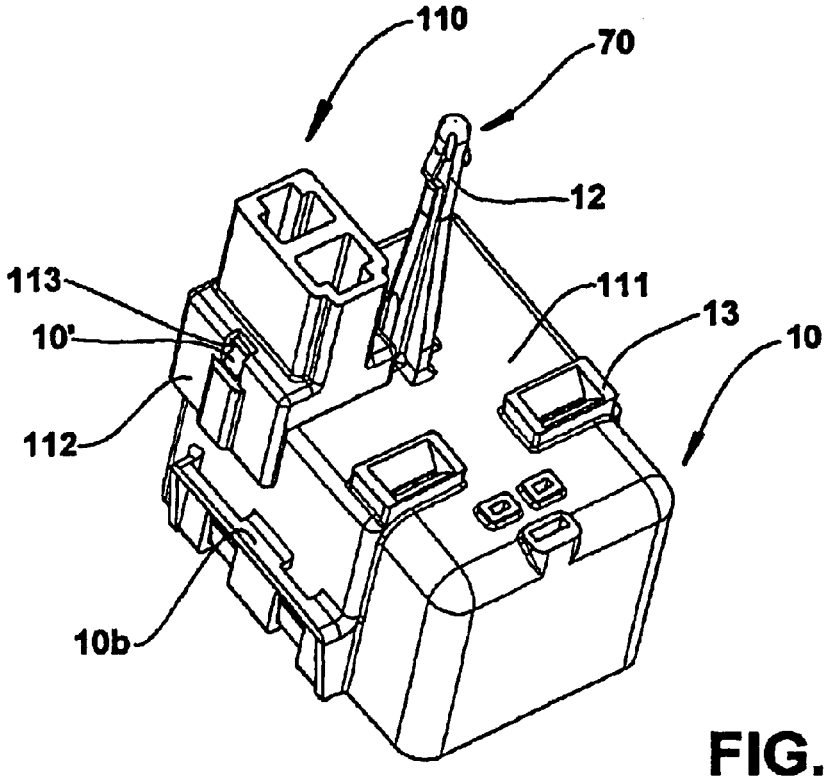
FIG. 20 illustrates the assembly of FIG. 19, in the mounted condition of the double tubular extension.
Figure 21:
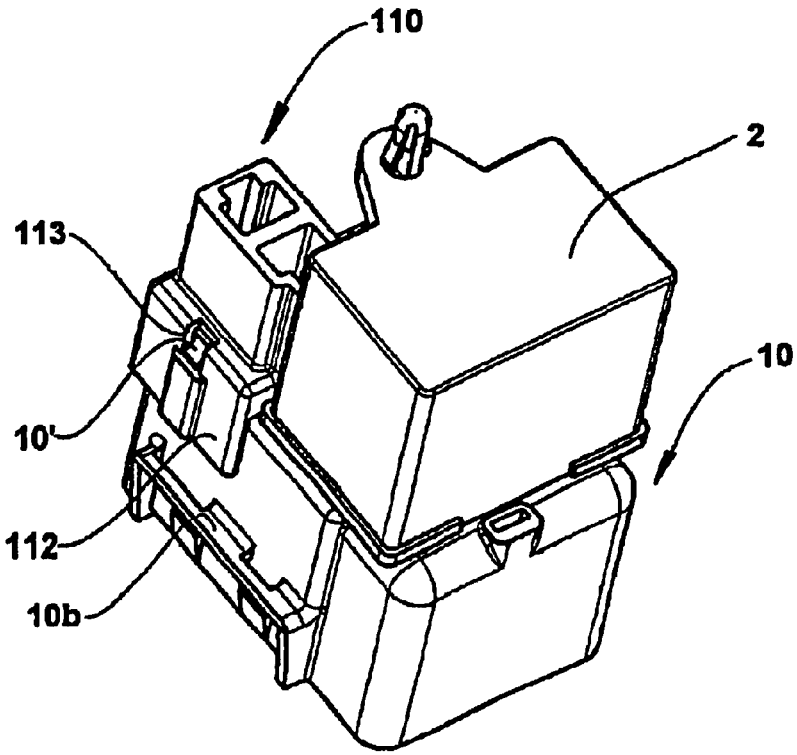
FIG. 21 is a similar view to that of FIG. 20, but further illustrating a capacitor mounted to the basic body of the starting system.

FIGS. 19, 20 and 21 illustrate a tubular extension 110, preferably in a double body, made of an electric insulating material and presenting a basic portion 111, to be seated onto the external face 11 of the basic body 10, around the energizing openings 15, 16, and incorporating orthogonal flanges 112, which will be seated against adjacent lateral faces of the basic body 10. Each flange 112 presents a retaining means, preferably in the form of a small window 113, into which is engaged a locking means, for example, a tongue 10', which is externally incorporated to the basic body 10. The double tubular etension 110 defines, after the optional mounting thereof to the basic body 10, a kind of protective sleeve around the supply terminals of the system, preventing said terminals from being inadvertedly accessed by the user.

What is claimed is:

1. A constructive arrangement for the starting system of an electric motor, comprising a basic body (10) to which are mounted a cover (20), a starting device (30) and a motor protector (40, 40'), characterized in that the basic body (10) is provided, on an external face (11), with: a projecting rod (12) for affixing a capacitor; a pair of first openings (13), for the fitting of respective terminals of the capacitor (2) to be coupled to the projecting rod (12), said pair of first openings (13) being arranged in alignment with a pair of first electric connectors (52) provided inside the basic body (10); a first energizing opening (15) for electric connection to the starting device (30); and a second energizing opening (16), for electric connection to the motor protector (40), said basic body (10) defining a first housing (17) for receiving the starting device (30) and being closed by the cover (20) opposite to the projecting rod (12) and provided with two receiving openings (21), which are aligned with a pair of female connectors (51) respectively and electrically connected to the first electric connectors (52) and lodged inside the basic body (10) for receiving two pins for electric connection to the motor, the motor protector (40, 40') being provided with a female connector (41) for the introduction of a third pin for electric connection of the motor and which is mounted inside a second housing (18) laterally affixed to the first housing (17), the motor protector (40, 40') being electrically associated with a contact pin (42, 42') aligned with the second energizing opening (16).

2. Arrangement, according to claim 1, characterized in that said external face (11) of the basic body (10) presents a pair of second openings (14) provided in alignment with a pair of second electric connectors (53), which are respectively and electrically connected to the first electric connectors (52) and provided inside the basic body (10), said second openings (14) being dimensioned to fit respective terminals of connecting cables for connection to the capacitor distant from the basic body (10), the first and the second openings (13, 14) being positioned relative to each other in such a way that the connection through the first openings (13) prevents connection and access to the second openings (14).

3. Arrangement, according to claim 2, characterized in that the second openings (14) are covered by the capacitor (2) in its condition mounted to the basic body (10) and to the projecting rod (12).

4. Arrangement, according to claim 3, characterized in that the projecting rod (12) is provided with axial retaining means (70) for said capacitor (2).

5. Arrangement, according to claim 2, characterized in that the projecting rod (12) is provided with axial retaining means (70) for said capacitor (2).

6. Arrangement, according to claim 2, characterized in that the second energizing opening (16) is provided in the basic body (10), in order to open to the inside of the second housing (18), in alignment with the contact pin (42, 42') incorporated to the motor protector (40, 41').

7. Arrangement, according to claim 6, characterized in that the projecting rod (12) is provided with axial retaining means (70) for said capacitor (2).

8. Arrangement, according to claim 1, characterized in that the first and second energizing openings (15, 16) are provided side by side, close to one of the lateral edges of the external face (11) of the basic body (10) where is incorporated the projecting rod (12), said energizing openings (15, 16) opening to the inside of the first housing (17).

9. Arrangement, according to claim 8, characterized in that the first openings (13) open to the inside of the first housing (17), in a region of the latter adjacent to the second housing (18) and opposite to the location of the energizing openings (15, 16) in relation to the projecting rod (12).

10. Arrangement, according to claim 9, characterized in that the first housing (17) receives two contact terminals (50) for the starting device (30), each having: one pair of said female connectors (51) in alignment with a respective receiving opening (21) of the cover (20), for receiving a contact pin of the terminal of the electric motor; said pair of first electric connectors (52), each being aligned with a respective first opening (13), and electric connection resilient means (54), positioning the starting device (30) inside the first housing (17) and effecting the electric contact with the starting device (30), one of said electric contact terminals (50) having the respective second electric contact (53) aligned with the first energizing opening (15), said first housing (17) further carrying a third contact terminal (55), having a first connecting portion (55*a*), to be electrically coupled to the contact pin (42) of the motor protector (40), and a second connecting portion (55*b*) operatively associated with the second energizing opening (16) of the basic body (10).

11. Arrangement, according to claim 10, characterized in that the projecting rod (12) is provided with axial retaining means (70) for said capacitor (2).

12. Arrangement, according to claim 9, characterized in that the projecting rod (12) is provided with axial retaining means (70) for said capacitor (2).

13. Arrangement, according to claim 8, characterized in that the projecting rod (12) is provided with axial retaining means (70) for said capacitor (2).

14. Arrangement, according to claim 8, characterized in that the tubular extension (110), of an electric insulating material, presents a basic portion (111), which will be seated and locked against said face (11) of the basic body (10), around the energizing openings (15, 16), defining a protective sleeve to involve the supply terminals of the system.

15. Arrangement, according to claim 14, characterized in that the basic portion (111) incorporates flanges (112) to be seated against adjacent lateral faces of the basic body (10), each flange (112) being provided with a retaining means (113) to be coupled to a locking means (10') externally incorporated to the basic body (10).

16. Arrangement, according to claim 15, characterized in that the projecting rod (12) is provided with axial retaining means (70) for said capacitor (2).

17. Arrangement, according to claim 14, characterized in that the projecting rod (12) is provided with axial (70) for said capacitor (2).

18. Arrangement, according to claim 1, characterized in that the projecting rod (12) is provided with axial retaining means (70) for said capacitor (2).

19. Arrangement, according to claim 18, characterized in that the capacitor (2) is retained to the projecting rod (12) by interference.

20. Arrangement, according to claim 18, characterized in that the axial retaining means (70) include at least one fixation tooth defined on at least part of the peripheral contour of the projecting rod (12).

21. Arrangement, according to claim 1, characterized in that the starting device (30) is an electronic plate mounted inside the basic body (10) through electric connection resilient means (54).

22. Arrangement, according to claim 1, characterized in that the basic body (10) includes, adjacent to a seating edge (10*a*) of the cover (20), lateral flanges (10*b*) provided with cover retaining means (60) for retaining fixation means (23) provided in said cover (20).

23. Arrangement, according to claim 1, characterized in that the second housing (18) is defined in the basic body (10)

and spaced from the first housing (17) by at least one wall (19), which is substantially orthogonal to the plane of the cover (20).

24. Arrangement, according to claim 23, characterized in that the basic body (10) defines, in a single piece, the first and the second housings (17, 18).

25. Arrangement, according to claim 23, characterized in that one of the parts defined by the first and the second housings (17, 18) carries engaging means (80) to be coupled to engagement receiving means (81) provided in the other of said parts.

26. Arrangement, according to claim 25, characterized in that each of the parts defined by the first and the second housings (17, 18) includes a locking means (90), which is selectively released from and engaged to locking means (90) provided in the other of said parts, so as to prevent involuntary uncouplings.

27. Arrangement, according to claim 26, characterized in that the engaging means (80) are mutually and slidingly cooperating guides.

28. Arrangement, according to claim 27, characterized in that at least part of the guides defines a dovetail fitting.

29. Arrangement, according to claim 28, characterized in that one of the parts defined by the first and the second housings (17, 18) includes a guide for slidingly fitting the locking means (90) provided in the other of said parts.

30. Arrangement, according to claim 1, characterized in that the motor protector (40, 40') has part of its extension seated against an adjacent portion of the cover (20) closing the first housing (17).

31. Arrangement, according to claim 1, characterized in that the first housing (17) is provided with an energizing terminal, defining the second energizing opening (16) and electrically and operatively engaged to a motor protector, which is distant from the basic body (10).

* * * * *